US006463916B1

(12) United States Patent
Coplin et al.

(10) Patent No.: US 6,463,916 B1
(45) Date of Patent: Oct. 15, 2002

(54) FUEL INJECTION SYSTEM FOR AN INTERNAL COMBUSTION ENGINE

(75) Inventors: Nicholas Coplin, Merriwa; Raymond John Hill, Beldon; Michael Leonard McKay, Kardinya, all of (AU)

(73) Assignee: Orbital Engine Company (Australia) Pty Limited, Balcatta (AU)

( * ) Notice: Subject to any disclaimer, the term of this patent is extended or adjusted under 35 U.S.C. 154(b) by 0 days.

(21) Appl. No.: 09/623,490

(22) PCT Filed: May 12, 1999

(86) PCT No.: PCT/AU99/00354

§ 371 (c)(1),
(2), (4) Date: Dec. 6, 2000

(87) PCT Pub. No.: WO99/58847

PCT Pub. Date: Nov. 18, 1999

(30) Foreign Application Priority Data

May 12, 1998 (AU) ..... PP3479

(51) Int. Cl.[7] ..... F02M 23/00
(52) U.S. Cl. ..... 123/531; 123/456
(58) Field of Search ..... 123/531, 533, 123/532, 73 C, 26, 585, 586, 590, 527, 456; 239/398, 407, 411

(56) References Cited

U.S. PATENT DOCUMENTS 4,934,329 A * 6/1990 Lear et al. ..... 123/531
5,024,202 A * 6/1991 McKay ..... 123/533
5,146,904 A 9/1992 Olson et al. ..... 123/533
5,526,796 A 6/1996 Thring et al. ..... 123/533
5,551,398 A * 9/1996 Gibson et al. ..... 123/446
5,622,155 A * 4/1997 Ellwood et al. ..... 123/531

* cited by examiner

*Primary Examiner*—Willis R. Wolfe
*Assistant Examiner*—Mahmoud Gimie
(74) *Attorney, Agent, or Firm*—Arent Fox Kintner Plotkin & Kahn

(57) ABSTRACT

A fuel injector assembly for an internal combustion engine, including:

a delivery chamber (5) located within the injector assembly (1);

a mass flow rate control means (50) for controlling the mass flow rate of fuel and compressed gas supplied to the delivery chamber (5), the mass flow rate being a function of the differential pressure across the mass flow rate control means (50); and valve means (9) for selectively communicating the delivery chamber (5) to the engine to deliver fuel to the engine;

wherein when the valve means (9) is opened, at least compressed gas is caused to flow thereby generating a differential pressure across the mass flow rate control means such that a controlled fuel flow is provided to the engine.

40 Claims, 5 Drawing Sheets

FUEL INJECTION SYSTEM FOR AN INTERNAL COMBUSTION ENGINE

The present invention is directed to a fuel injection system for an internal combustion engine. In particular, the present invention is applicable for direct fuel injection into a combustion chamber of an engine and will be described in this application. It is however to be appreciated that the present invention is equally applicable for manifold and other fuel injection applications.

The Applicant is involved in the development of air-assisted fuel injection systems for use in internal combustion engines. As a primary feature, these systems utilise air to entrain and inject a quantity of fuel directly into a combustion chamber of the engine. In one particular system, such as that described in the Applicants' U.S. Pat. No. 4,934,329 , the contents of which are hereby incorporated by reference, a separate fuel injector and delivery valve are provided for each combustion chamber, the fuel injector supplying a metered quantity of fuel to a delivery chamber of the delivery valve. The fuel is then delivered to the combustion chamber by opening the delivery valve so that fuel is entrained and delivered by pressurised gas. Typically, an air compressor supplies the pressurised gas to the delivery chamber.

In a variation of the above system, such as that described in the Applicants' U.S. Pat. No. 5,622,155 , the contents of which are hereby incorporated by reference the pressurised gas is supplied from an air chamber in communication with the delivery chamber. Combustion gases from the combustion chamber are allowed to enter this air chamber by delaying the closing of the delivery valve, the trapped combustion gases being subsequently used for the next fuel injection event. The latter system is particularly applicable in lower cost and small engine applications where reduced complexity is often desirable.

However, the latter system presents a number of challenges in regard to certain applications in that functionality of the fuel system may often be reduced and less accurate fuel metering may be evidenced. Accordingly, an air-assisted fuel injection system which avoids the need for separate fuel injectors and delivery valves for each combustion chamber but which maintains functionality and fuel metering accuracy would be advantageous.

To this end, the Applicant has developed a fuel injection system which eliminates the need for a separate fuel injector for each combustion chamber. This system, which is described in the Applicant's U.S. Pat. Nos. 4,794,902, 4,841,942 and 5,024,202, uses an injection apparatus having a delivery chamber and a delivery valve. Pressurised fuel and pressurised gas are separately supplied to the delivery chamber of the injection apparatus. The pressure differential between the fuel and gas supplied to the chamber is regulated such that the gas pressure is less than the fuel pressure. During the opening of the delivery valve, an associated valve allows the pressurised gas to flow into the delivery chamber, said pressure differential controlling the quantity of fuel delivered during the period of opening of the delivery valve. Nevertheless, whilst this fuel injection system does not require a fuel injector for each combustion chamber, the injection apparatus utilises numerous components to enable the gas flow to be controlled such that the gas only flows when the delivery valve is opened. It is necessary to separate the air and fuel flows until the actual injection event because of the difference in the gas and fuel pressures.

Another air-assisted fuel injection system is described in SAE Paper No. 9,703,62 M Nuti et al, "FAST Injection System: PIAGGIO Solution for VLEV 2T SI Engines". This system incorporates a piston pump driven by a crankshaft. An air/fuel mixture is provided by a carburettor to the crankcase of the pump. This mixture is then pressurised and transferred to a working chamber. A poppet valve delivers this mixture to the combustion chamber of the engine, the opening pressure of the poppet valve being regulated by a calibrated preloaded spring. Apart from the complexity of this arrangement, another disadvantage of this purely mechanical system is that it is not possible to control the opening and closing times and the period of opening of the poppet valve thus limiting the overall functionality of the system. This limits the applicability of such a system to small engines which can tolerate relatively inaccurate control of the fuelling rate.

It is therefore an object of the present invention to provide a fuel injector assembly, which avoids one or more of the disadvantages referred to above.

With this in mind, according to one aspect of the present invention, there is provided a fuel injector assembly for an internal combustion engine, including:

- a delivery chamber located within the injector assembly;
- a mass flow rate control means for controlling the mass flow rate of fuel and compressed gas supplied to the delivery chamber, the mass flow rate being a function of a differential pressure across the mass flow rate control means; and
- valve means for selectively communicating the delivery chamber to the engine to deliver fuel to the engine;
- wherein the assembly is adapted such that in use, when the valve means is opened, at least compressed gas is caused to flow thereby generating a differential pressure across the mass flow rate control means such that a controlled fuel flow is provided to the engine.

According to another aspect of the present invention, there is provided a fuel injector system for an internal combustion engine, including;

- at least one fuel injector assembly having a delivery chamber located therein;
- a fuel supply means for supplying fuel to the delivery chamber;
- a compressed gas supply means for supplying compressed gas to the delivery chamber;
- a mass flow rate control means for controlling the mass flow rate of the fuel and the compressed gas supplied to the delivery chamber, the mass flow rate being a function of the differential pressure across the mass flow rate control means; and
- valve means for selectively communicating the delivery chamber of the fuel injector assembly to the engine to deliver fuel to the engine,
- wherein said system is adapted such that in use, when the valve means is opened, at least compressed gas is caused to flow thereby generating a differential pressure across the mass flow rate control means such that a controlled fuel flow rate is provided to the engine.

The fuel and gas flow rates are a function of the differential pressure across the mass flow rate control means. Furthermore, the amount of fuel delivered to the engine is a function of the differential pressure, the timing of the opening of the valve means and the characteristics of the mass flow rate control means.

A pressure-time fuel metering system is therefore provided. The amount of fuel may be varied by controlling the fuel and gas supply pressures to thereby control the differential pressure. Furthermore, the amount of fuel delivered to the engine may be controlled by varying the period of opening of the valve means, and/or the start and end times of the valve period opening for a given gas and fuel flow rate control means and differential pressure.

The differential pressure is generated by the pressure loss due to the flow of the gas through the mass flow rate control means. This differential pressure then promotes fuel flow through the mass flow rate control means. The differential pressure across the mass flow rate control means may be the difference between the supply pressure of the supplied fuel and the supplied compressed gas and the pressure immediately downstream of the mass flow rate control means. In applications where the fuel injection system is used in direct injection applications, the delivery chamber pressure is affected by cylinder pressure but controlled by losses across the valve means.

The fuel injection system may further include pressure equalising means for at least substantially equalising the supply pressure of the fuel supplied by the fuel supply means and the compressed gas supplied by the compressed gas supply means to the delivery chamber.

The mass flow rate control means may include a fuel mass flow rate control means and a gas mass flow rate control means. According to one preferred embodiment, the fuel flow rate control means may be in the form of a fuel orifice and the gas flow rate control means may be in the form of a gas orifice. The fuel orifice may be located in the fuel supply means for controlling the mass flow rate of the fuel supplied to the delivery chamber. The gas orifice may be located in the gas supply means for controlling the mass flow rate of the compressed gas supplied to the delivery chamber which instigates the differential pressure. More particularly, the gas orifice may separate a gas supply passage of the fuel injector assembly from the delivery chamber, and the fuel orifice may separate a fuel supply passage of the fuel injector assembly from the delivery chamber.

According to another preferred embodiment, the mass flow rate control means may include a venturi passage provided within the gas supply means. More particularly, the venturi passage may separate a gas supply passage of the fuel injection assembly from the delivery chamber. The venturi passage may include a throat section, and a fuel orifice may be provided within the throat section of the venturi. The fuel orifice may be in communication with the fuel supply means. More particularly, the fuel orifice may separate a fuel supply passage of the fuel injector assembly from the delivery chamber. Any flow of gas through the venturi passage will instigate a differential pressure which results in entrainment of the fuel from the fuel supply means.

The gas mass flow rate for the fuel injection system may be selected such that it contributes to the optimisation of the penetration rate for different engine cylinder capacities (or stroke). Furthermore, the characteristics of the gas flow rate control means may be selected to vary the magnitude of the differential pressure. The magnitude can also be controlled by retarding or advancing the timing of opening of the valve means. Therefore, advanced timings would result in a higher differential pressure and, conversely, at retarded timings, the differential pressure would be lower.

The selection of the characteristics of the fuel flow rate control means in combination with the differential pressure determines the metering rate of the fuel injection system. The available metering window is selected to balance the minimum and maximum engine fuelling requirements within the constraints of fuel containment, mixture preparation an so on.

The combined effect of the two orifii or the venturi arrangement as described above establishes the average injected air-fuel ratio of the mixture which will be delivered to the engine. The ratio of the orifii size may therefore determine the air-fuel ratio of the mixture, whereby the air-fuel ratio is typically much richer than what is necessary for combustion.

According to one preferred arrangement, the valve means may be provided in the form of a solenoid actuated injector. The injector is located to thereby provide direct injection of fuel and compressed gas into the combustion chamber of the engine and may be actuated by an electronic control unit as a function of engine operating parameters. According to an alternative preferred embodiment, the valve means may be provided in the form of a mechanically actuated valve located to provide for direct supply of fuel and compressed gas to the combustion chamber of the engine. Such a valve may include mechanical actuation means for opening the valve, the duration of the valve opening being controlled as a function of engine demand, for example by a mechanical governor for altering the duration.

Alternatively or in addition, the valve may include spring regulation means, the valve opening when the pressure of the supplied fuel and gas to the valve is at or above a preset pressure. In the latter arrangement, a further valve may be required to regulate the supply of fuel and/or compressed gas to the mechanical valve. This further valve may be located on the fuel or gas supply means or immediately upstream of the mechanical valve. The further valve may be controlled by an electronic control unit as a function of engine operating parameters.

When the valve means is closed, the differential pressure across the mass flow rate control means may be at least substantially zero and there may therefore be no flow of fuel or compressed gas in the fuel injection system. When the valve is opened, the gas and possibly also the fuel begins flowing. The gas flow generates a differential pressure, which is equal to the difference in the supply pressure of the fuel and compressed gas and the pressure immediately downstream of the mass flow rate control means. This differential pressure is experienced across the mass flow rate control means resulting in the flow of the fuel and compressed gas to the valve means. The mass flow rate of the fuel and compressed gas is hence a function of the abovenoted differential pressure.

The fuel supply to the delivery chamber may be such that fuel may continue to be supplied to the delivery chamber for a short period immediately following the closing of the valve means. This may be attained by the inertia of the fuel within a fuel supply line connected to the valve means immediately following closing of the valve means. As discussed further hereinafter, the fuel flux of the fuel injector assembly may therefore be such that the supply rate of fuel at the initial opening of the valve means is significantly higher immediately following the opening of the valve means. This can lead to improved combustion control within the engine for certain operating conditions.

The pressure equalising means may be in the form of a closed tank located upstream of the mass flow rate control means. A fuel supply arrangement may supply fuel to the closed tank and a compressed gas supply arrangement may supply compressed gas to the closed tank. A float valve arrangement may be provided within the tank to allow fuel into the tank until the fuel reaches a preset level therein to thereby regulate the level of the fuel within the tank. Additional fuel may then be prevented from entering the tank until the fuel level has fallen a predetermined amount.

This arrangement results in at least substantial equalisation of the fuel supply pressure and the compressed gas supply pressure upstream of the mass flow rate control means. The fuel level may alternatively be controlled by an electronic sensor, or using an ECU strategy for the benefit of minimising the operating time of the fuel pressure supply device. It is however also possible for a conventional regulator or an electronic regulator to be used to equalise the fuel and gas supply pressures.

Conveniently, the absolute pressure of the pressure equalising means (ie. relative to atmospheric conditions) need not be controlled. It is preferable to control the pressure of the gas, with the fuel pressure being adjusted to track the gas pressure. It is however also possible for the fuel pressure to be controlled, with the gas pressure being adjusted accordingly, or to have both the fuel and gas pressures separately controlled.

When the pressure equalising means incorporates a tank, any fuel vapour generated therein by the heating of the fuel or due to the supply device or operating environment can also be delivered to the engine by way of the fuel or gas mass flow control means. A temperature sensor provided in the gas volume, combined with knowledge of the pressure within the pressure equalising means may be used to compute the fuel quantity in the gas thus allowing correction of the duration of the fuel metering time.

The compressed gas may be compressed air, and the compressed gas supply means may include an air compressor. A pressure regulator may optionally be provided downstream of the air compressor.

The fuel supply means may include a fuel tank and a fuel pump operatively arranged with respect to the fuel tank. For example, the fuel pump may be located downstream of the fuel tank.

Damper means may optionally be provided for the fuel supply line and/or a gas supply line to minimise pressure pulses within these lines.

The fuel injection system may also include check valve means for controlling the fuel and/or gas flows within the system. The check valve means can be located either upstream or downstream of the fuel flow rate control means, and/or either upstream or downstream of the gas flow rate control means.

The provision of a check valve means adjacent the fuel flow rate control means can lead to certain benefits some of which are listed below:

- it prevents the creep of air, due to buoyancy or other mechanisms, into the fuel circuit upstream of the fuel flow rate control means. This enables the fuel injection system to accommodate small variations between the fuel and gas supply pressures.
- it contributes to the control of the time delay between the initiation of the differential pressure and the onset of fuel metering. This can lead to significant improvements in the accuracy of the fuel metering.
- it de-sensitises the system to variations in "fuel head" between cylinders on an installation which has a vertical crank axis and vertically displaced cylinders. Such an arrangement is common on outboard marine engines.
- it de-sensitises the system to pressure fluctuations which may be present in either the gas or fuel supply circuits.
- it improves the turn-off response of the fuel metering event by providing a more rapid drop in the differential pressure.
- it de-sensitises the system to engine vibrations.

The provision of the check valve means adjacent the gas flow rate control means can contribute to improved control of the time delay between the initiation of the pressure decay within the delivery chamber and the onset of the gas flow process.

It is also envisaged that the gas flow rate control means may be parallelled with a secondary gas flow path checked in the opposing flow direction. The purpose of this arrangement is to have one gas flow characteristic when the flow-direction is from the gas supply to the combustion chamber, and to have a typically less restrictive second gas flow characteristic when flowing gas may flow from the combustion chamber in to the gas supply circuit. In this mode of operation, gas from the combustion chamber is captured and used for the next injection event. This differential in flow rates allows the time of exposure in this operational mode to be reduced in addition to minimising the gas quantity injected.

The characteristics of the fuel flow rate control means can be optimised to control the phasing of the fuel supply event relative to the valve opening event to thereby provide fuel flux control. For example, it is often preferable to provide a fuelling profile having a rich leading edge and a lean trailing edge. The delay of the onset of fuel metering can be influenced by the check valve means as discussed above. This delay may also be influenced by the capacitive effect of the volume of the delivery chamber. The larger the volume, the slower the pressure decay rate. This leads to the slower onset of fuel metering. The delay of the end of the fuel supply event may be controlled by delaying the substantial equalisation of the gas and fuel pressures thereby biasing the quantity of fuel metered after the closure of the valve means such that the delivery chamber can be utilised as a holding chamber. A time based delay may also be introduced by setting or controlling the distance, or transportation rate between the fuel flow rate control means and the gas flow rate control means. Alternatively, the distance between the fuel and gas flow rate control means and the valve means can be varied.

According to a further aspect of the present invention, there is provided a method of metering fuel to an internal combustion engine having at least one fuel injector assembly including a delivery chamber, a mass flow rate control means for controlling the mass flow rate of compressed gas and the mass flow rate of fuel supplied to the delivery chamber, and valve means for selectively communicating the delivery chamber to the engine to deliver fuel to the engine, the method including:

providing a source of fuel to the delivery chamber;

providing a source of compressed gas to the delivery chamber;

controlling the mass flow rate of fuel and gas supplied to the delivery chamber as a function of the differential pressure across the mass flow rate control means;

opening the valve means to thereby allow compressed gas to flow therethrough resulting in a differential pressure being generated across the mass flow rate control means such that a controlled fuel flow is provided to the engine.

Conveniently, where the mass flow rate control means includes a gas flow rate control means for controlling the mass flow rate of compressed gas and a fuel flow rate control means for controlling the mass flow rate of fuel, the mass flow rate of gas supplied to the delivery chamber is controlled as a function of the differential pressure across the gas flow rate control means and the mass flow rate of fuel supplied to the delivery chamber is controlled as a function of the differential pressure across the fuel flow rate control means.

The method may further include regulating the supply pressure of the fuel and of the gas to the delivery chamber such that the fuel supply pressure is at least substantially equalised with the gas supply pressure.

The delivery chamber may communicate with a combustion chamber of the engine, and hence the delivery chamber pressure is affected by cylinder pressure but is controlled by losses across the valve means.

The method may further include restricting communication of the fuel source with the delivery chamber until the differential pressure exceeds a predetermined level. This helps to improve the accuracy of the fuel metering to the engine for reasons that will by subsequently explained.

The amount of fuel supplied to the engine may. be controlled by controlling at least one of the fuel and gas supply pressures. More particularly, the amount of fuel supplied to the engine may be initially controlled by varying the period of opening of the valve means. Alternatively or in addition, the amount of fuel supplied to the engine may be initially controlled by varying the start and/or end times of the opening of the valve means.

The gas supplied to the delivery chamber may be air. Other types of gases such as an inert gas, captured combustion gases from the engine or even LPG are however also envisaged. Furthermore, the fuel supplied to the delivery chamber is typically in liquid form, although the supply of gaseous fuels are also envisaged.

The fuel injection system according to the present invention hence provides a dual fluid fuel system which retains the advantages of such systems, (ie, improved atomisation of the fuel and fuel spray formation). This fuel injection system however has less components than certain versions of the Applicant's earlier electronic fuel injection systems and eliminates the need for separate fuel and gas solenoid actuated injectors. In some applications, even the need for any such solenoid actuated injectors may be eliminated. This leads to significant cost savings and less complexity in the control of the fuel injection system of the present invention whilst maintaining functionality.

It will be convenient to further describe the present invention with respect to the accompanying drawings which illustrate preferred embodiments of the invention. Other embodiments of the invention are possible and consequently, the particularity of the accompanying drawings is not to be understood as superseding the generality of the preceding description of the invention.

The present invention can be used to provide direct fuel injection into the combustion chamber of an engine and, whilst not limited as such, the fuel injection system of the present invention will hereinafter be described for such an application.

Figure 1:
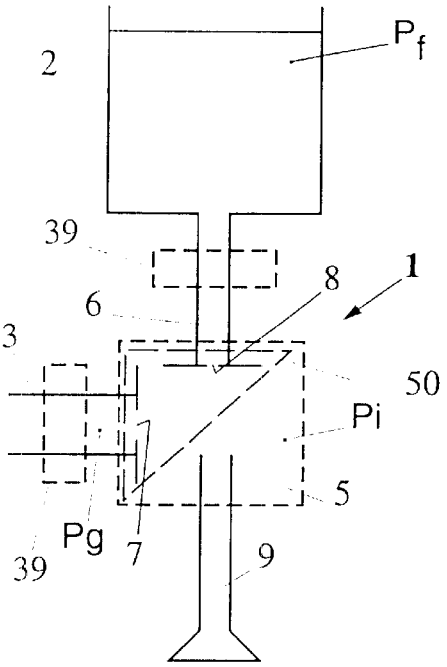
FIG. 1 is a schematic view of a first preferred embodiment of a fuel injector assembly according to the present invention.

FIG. 1 illustrates the principle of operation of a fuel injector assembly and fuel injection system according to the present invention. The fuel injector assembly 1 has a delivery chamber 5 therein. A fuel supply means 2 delivers fuel via a fuel supply line 6 to the delivery chamber 5. The mass flow rate of the fuel into the delivery chamber 5 is controlled by means of a fuel flow rate control means 8 located downstream of the fuel supply line 6. The fuel flow rate control means 8 is shown as a fuel orifice in FIG. 1.

Compressed gas is also supplied to the delivery chamber 5 through a gas supply line 3. The mass flow rate of the gas supplied to the delivery chamber 5 is similarly controlled by a gas flow rate control means 7 located downstream of the gas supply line 3. The gas flow rate control means 7 is shown as a gas orifice in FIG. 1. The fuel flow rate control means 8 and the gas flow rate control means 7 together define the mass flow rate control means 50 as shown in FIG. 1.

The fuel injection system regulates the fuel supply pressure $P_f$ and the gas supply pressure $P_g$ such that the fuel and gas supply pressures are substantially equalised.

The delivery chamber 5 is in cyclic communication with an engine combustion chamber (not shown). The communication of the delivery chamber 5 to the combustion chamber is controlled by a valve assembly 9 schematically shown as a poppet valve in FIG. 1. The valve assembly 9 may typically be a delivery or air injector such as that described in the Applicants' aforementioned U.S. Pat. No. 4,934,329. When the delivery chamber 5 is isolated from the combustion chamber, the fuel and gas supply pressures $P_f$, and $P_g$ are substantially the same as the pressure within the delivery chamber $P_i$. There is therefore substantially no differential pressure across the fuel flow rate control means 8 or across the gas flow rate control means 7. Therefore, little to no fuel and gas flow through the respective orifii into the delivery chamber 5 when the valve 9 is closed. The provision of the respective optional check valves 39 ensure that there is no flow until the differential pressure reaches a desired level.

Following opening of the valve assembly 9, a pressure difference is established between the fuel and gas supply pressures $P_f$, $P_g$ and the delivery chamber pressure $P_i$ which is primarily instigated by the restriction of gas flow. This results in a differential pressure being developed across both the fuel orifice 8 and the air orifice 7. The differential pressure produces a fuel flow through the fuel orifice 8 into delivery chamber 5 and an air flow through the air orifice 7 into the delivery chamber 5. An air/fuel mixture can then be delivered from the delivery chamber 5 by way of the valve 9 to the combustion chamber.

The amount of fuel supplied to the engine is therefore a function of the differential pressure produced when the valve 9 is opened as well as the duration of the opening of the valve 9. The fuel injection system is therefore similar to the Applicant's aforementioned earlier fuel injection systems in that it is based on a pressure-time delivery principle. The principal difference is that the need for a separate fuel injector for each combustion chamber is eliminated.

Figure 2:
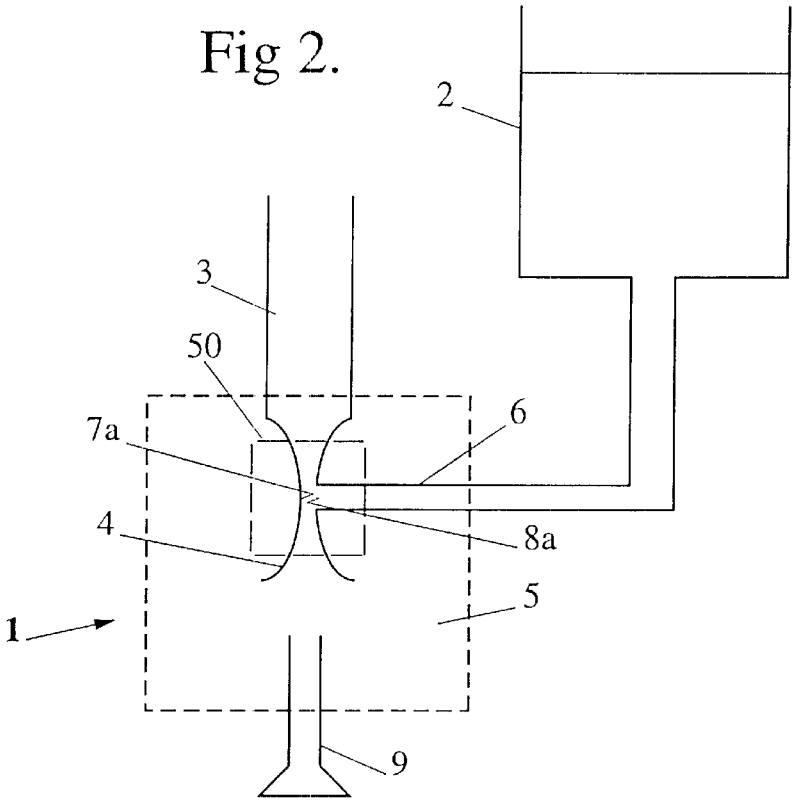
FIG. 2 is a schematic view of a second preferred embodiment of a fuel injector assembly according the present invention.

FIG. 2 shows another preferred embodiment of a fuel injection system and fuel injector assembly according to the present invention. It should be noted that features corresponding to those shown in FIG. 1 are designated with the same reference numerals for clarity reasons. The principle difference with the embodiment shown in FIG. 1 is that the gas supply line 3 supplies gas to the delivery chamber 5 through a venturi passage 4. The mass flow rate of the gas supplied to the delivery chamber is controlled by the throat 7*a* of the venturi 4 which operates in the same way as the gas orifice 7 of FIG. 1. Fuel is delivered from a fuel supply means 2 and through a fuel supply line 6 to a fuel orifice 8*a* provided at the venturi throat 7*a*, the fuel orifice 8*a* of the fuel supply line 6 operating in the same way as the fuel orifice 8 of FIG. 1. This embodiment otherwise operates in the same way as the embodiment of FIG. 1, with the throat 7*a* and the fuel orifice 8*a* together defining the mass flow rate control means 50.

Figure 3:
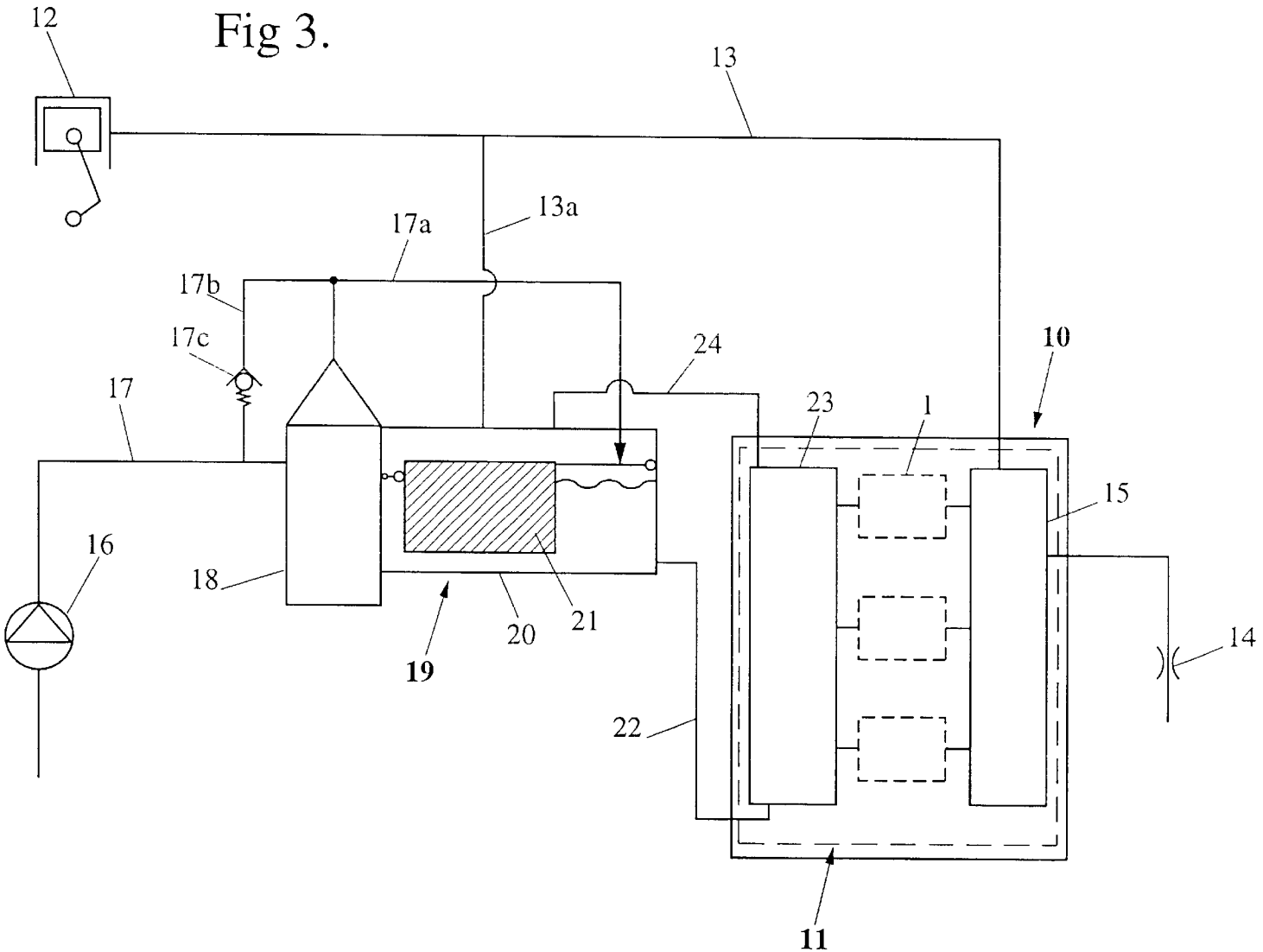
FIG. 3 is a schematic view of a fuel injection system according to the present invention.

FIG. 3 provides an overall fuel injection system schematic showing one preferred embodiment of this system for an engine 10. The compressed gas is supplied by a compressor 12 which delivers compressed gas through a gas passage 13 to an air duct 15 of an air and fuel rail 11 of the engine 10. The air duct 15 provides the compressed gas to the or each delivery or fuel injector assembly 1, an injector assembly 1 being provided for each cylinder of the engine 10. The gas pressure within the air duct 15 is further regulated by a regulator 14 in communication with the air duct 15.

Part of the compressed gas is diverted through a bypass line 13*a* to a pressure equalising means 19. This pressure equalising means 19 is in the form of a tank 20 containing a float valve 21 therein. Fuel is supplied from a fuel tank (not shown) through a fuel passage 17 to the pressure equalising means 19. The fuel is delivered to the tank 20 of the pressure equalising means 19 using a high pressure fuel pump 18. A lift pump 16 may also be provided upstream of the fuel pump 18 where required. The fuel supply to the tank 20 is controlled by the float valve 21. Fuel is allowed to flow through fuel supply passage 17*a* into the tank 20 until the fuel level within the tank 20 reaches a pre-determined point, at which time the float valve 21 closes to prevent further fuel flow into the tank 20. Excess fuel is then redirected to a fuel bypass line 17*b* back to the fuel supply passage 17. The one way valve 17*c* on the fuel bypass line 17*b* acts as a limiter to prevent over pressurisation within the system upstream of the fuel pump 3.

Because compressed gas is also provided to the tank 20, this results in substantial equalisation of both the fuel and gas pressures therein. Fuel from the tank 20 is then provided through a further fuel supply passage 22 to a fuel duct 23 of the air and fuel rail 11 of the engine 10. The fuel duct 23 then supplies fuel to the injectors 1. Any fuel vapour which may have accumulated within the tank 20 of the pressure equalising means 19 can also be delivered through to the fuel duct 23 for subsequent combustion by the engine 10 by way of a fuel vapour line 24. The injectors 1 control the flow rate of the fuel to the engine 10 on the basis of the differential pressure created across the mass flow rate control means 50 in the manner as described previously.

Figure 4:
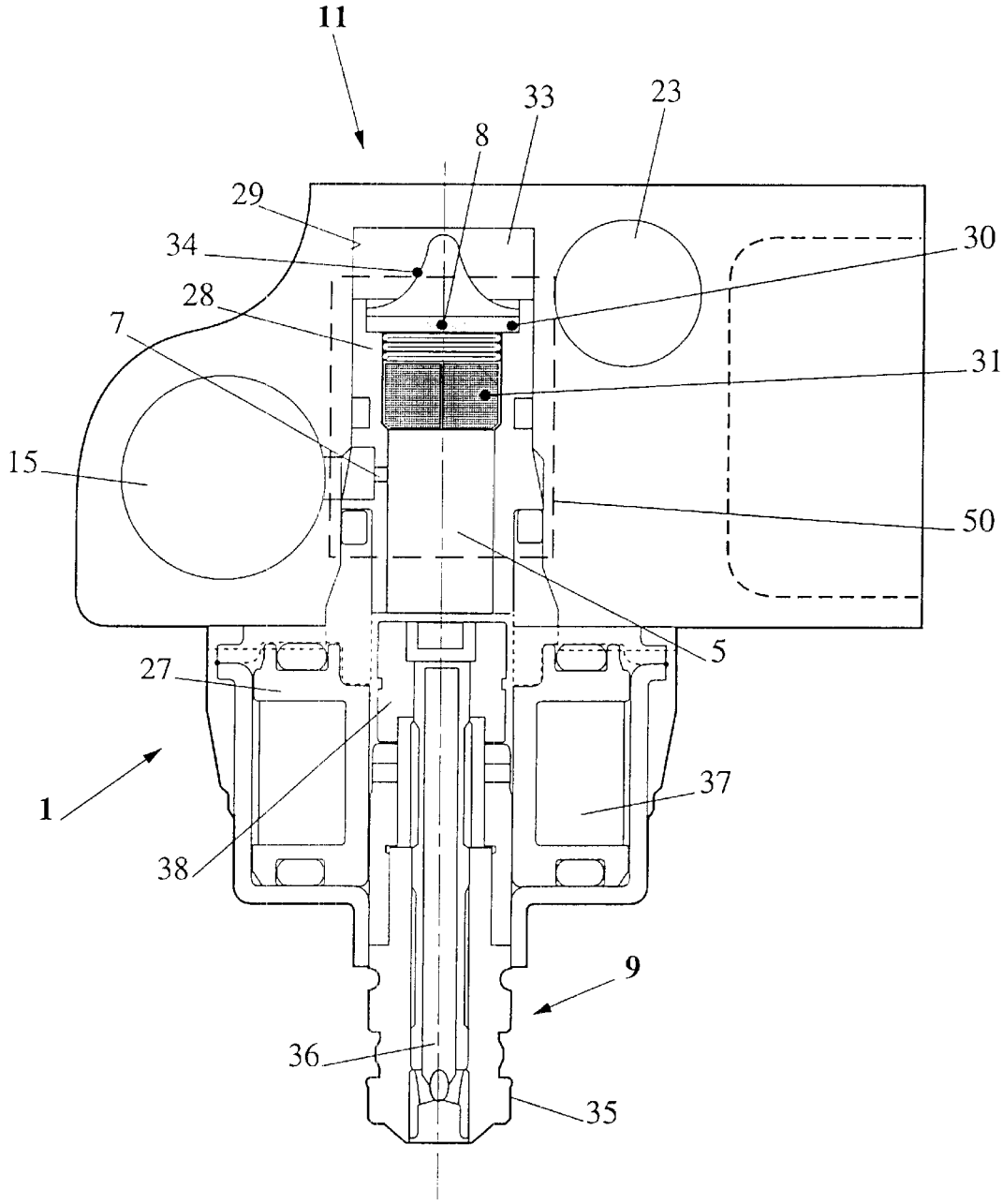
FIG. 4 is a cross-sectional view of a third preferred embodiment of a fuel injector assembly according to the present invention.

FIG. 4 shows a further preferred embodiment of a fuel injector assembly 1 according to the present invention. The same reference numerals to those used for corresponding components in FIGS. 1, 2 and 3 are used in FIG. 4 for clarity purposes. FIG. 4 shows an injector 1 according to the present invention supported on the air and fuel rail 11. The valve assembly 9 is shown as a solenoid actuated injector having an injector nozzle 35, the end of which is located within an engine combustion chamber (not shown). A poppet valve 36 controls the flow of the air/fuel mixture into the combustion chamber. The movement of the poppet valve 36 is actuated by the cyclic energisation of a solenoid coil 37 in the known manner, with an armature 38 actuated by the solenoid coil 37 being operatively connected to the poppet valve 36.

A housing 28 is provided upstream of the valve assembly 9 and is located within a cavity 29 within the air and fuel rail 11. The housing 28 accommodates the delivery chamber 5. Air is delivered through the air duct 15 of the air and fuel rail 11, with a passage 27 being provided from the air duct 15 to an air orifice 7 located within a side wall of the housing 28 to the delivery chamber 5. Fuel is supplied through the fuel duct 23 to a fuel cavity 33 within the housing 28. A fuel screen 34 filters the fuel prior to passing through a fuel orifice disc 30 providing the fuel orifice 8. The mass flow rate control means 50 is provided by the elements shown in the confines of the dotted lines in FIG. 4.

A check valve assembly 31 is provided downstream of the fuel orifice disc 30. The purpose of the check valve assembly 31 is to prevent compressed gas from seeping into the fuel supply where there is any variation between the gas and fuel supply pressures. The check valve assembly 31 however also leads to operational advantages as best shown by referring to FIG. 5.

In operation the initial opening of the valve assembly 9 results in the start of a flow of gas through the air orifice 7 from the air duct 15. Some fuel flow may also occur across the fuel orifice 8 at this time. However the provision of a check valve 39 in the fuel line as alluded to hereinbefore prohibits this until the differential pressure reaches a desired level. The gas flow generates a differential pressure which then produces a controlled fuel flow of fuel.

The fuel injector assembly 1 operates in the manner previously described. To reiterate, when the delivery chamber 5 is isolated from the combustion chamber, the fuel and gas supply pressures $P_f$, and $P_g$are substantially the same as the pressure within the delivery chamber $P_i$. There is therefore substantially no differential pressure across the fuel flow rate control means 8 or across the gas flow rate control means 7. Therefore, little to no fuel and gas flow through the respective orifii into the delivery chamber 5 when the valve 9 is closed. The provision of the respective optional check valves 39 ensure that there is no flow until the differential pressure reaches a desired level.

Following opening of the valve assembly 9, a pressure difference is established between the fuel and gas supply pressures $P_f$, $P_g$ and the delivery chamber pressure $P_i$ which is primarily instigated by the restriction of gas flow. This results in a differential pressure being developed across both the fuel orifice 8 and the air orifice 7. The differential pressure produces a fuel flow through the fuel orifice 8 into delivery chamber 5 and an air flow through the air orifice 7 into the delivery chamber 5. An air/fuel mixture can then be delivered from the delivery chamber 5 by way of the valve 9 to the combustion chamber.

Figure 5:
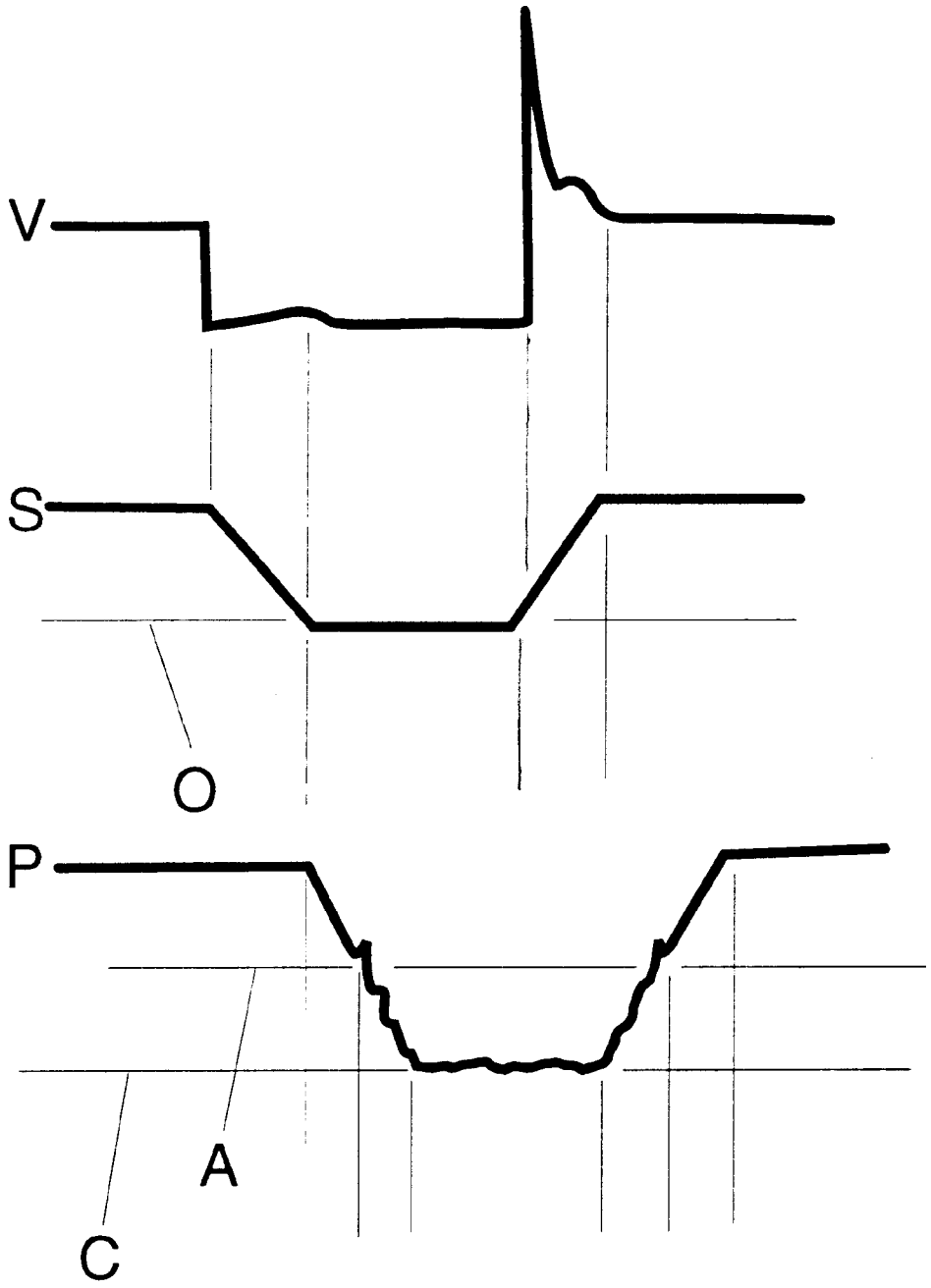
FIG. 5 is a plot illustrating the operation of the fuel injector assembly of FIG. 4.

FIG. 5 shows a series of plots, the top plot V showing the voltage signal to the solenoid coil 37, the middle plot S showing the displacement of the poppet valve 36 as a result of the voltage signal and the lower most plot P showing the change in the internal pressure within the delivery chamber 5 due to the opening of the poppet valve 36. From the plots it can be noted that following a short delay after the voltage signal is received by the injector assembly 9, the poppet valve 36 opens to its fully open position as shown at level 0 of plot S. As the poppet valve 36 opens, the differential pressure across the fuel and air orifii progressively increases until it reaches a steady state value as shown at level C on plot P. The check valve assembly 31 normally prevents fuel from entering the delivery chamber 5 until the differential pressure reaches a pre-set level as shown at level A on plot P. This prevents fuel seeping into. the delivery-chamber 5 as a result of fluctuations of the internal pressure therein, for example due to variations in the gas supply pressure. Furthermore, the check valve assembly 31 only allows for delivery of fuel through the fuel orifice 8 when the differential pressure exceeds the pre-set level. This acts to provide for more accurate fuel metering by the fuel injection system. Following closure of the poppet valve 36, there is a small delay before the internal pressure within the delivery chamber 5 returns to its initial level. This results in the continuing supply of fuel to the delivery chamber 5 for a short period after closure of the poppet valve 36. A small supply of fuel is then held within the delivery chamber 5 until the next injection event. This leads to a beneficial fuel flux from the fuel injector because a rich air fuel mixture is initially supplied when the injector 1 is opened, the air fuel mixture becoming progressively leaner near the end of the injection period.

Figure 6:
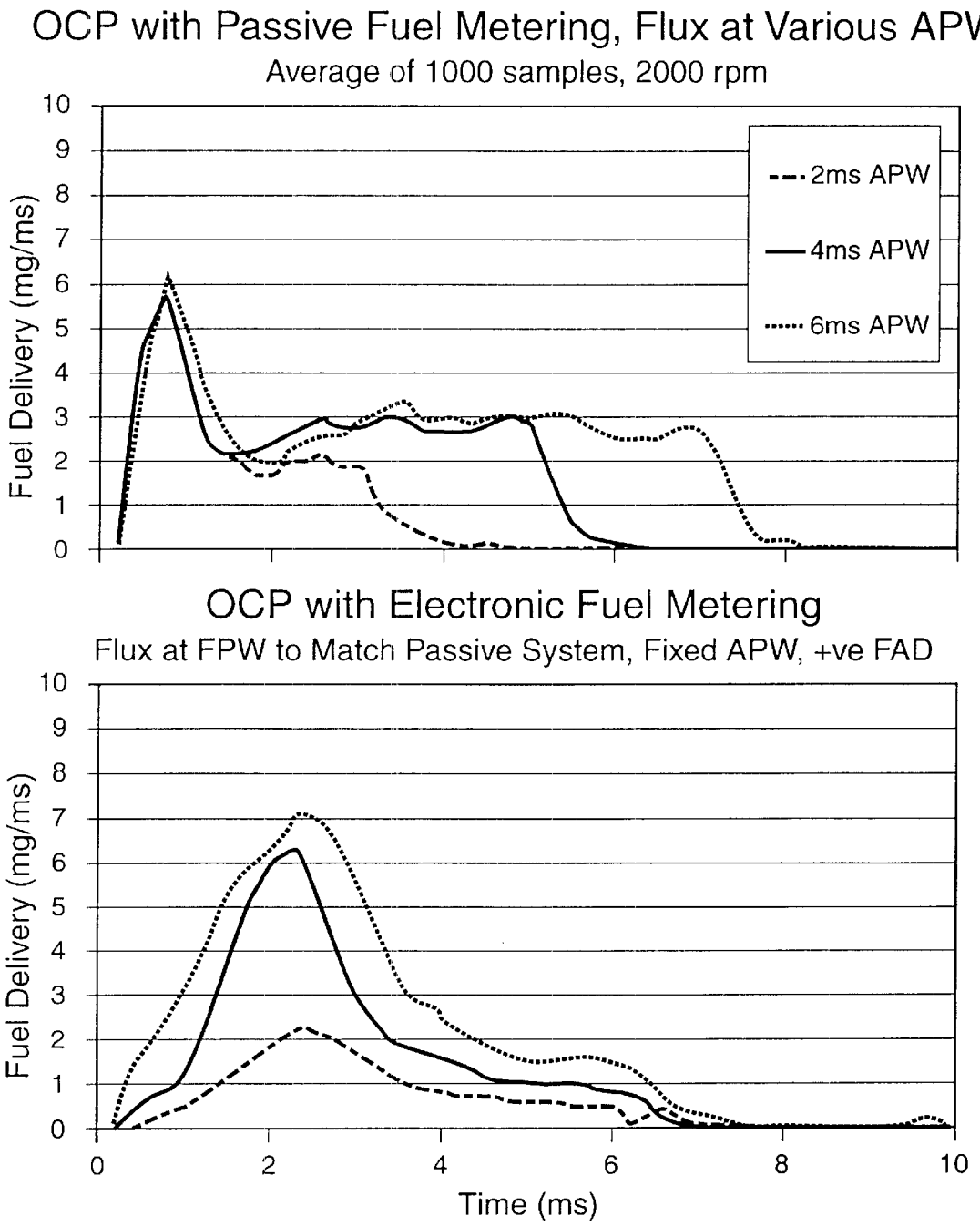
FIG. 6 is a graphical representation of the typical fuel flux profiles of a fuel injector assembly of the present invention in comparison with an electronic fuel metering system.

FIG. 6 show typical examples of the fuel flux profiles achievable with the fuel system of the current invention compared with an electronic fuel metering system such as that described in the Applicants' U.S. Pat. No. 4,934,329. It is to be understood that optimisation of the physical geometry of the passive fuel metering system of the current invention allows for the air-fuel interaction to be controlled to thereby allow for the similar variation of the fuel metering profile as is achievable with electronic fuel phasing control. For example, it is found that by changing the distance between the fuel and gas flow rate control means and the valve means, the delivery profiles achieved by the electronic system could be approximated. As can be seen in FIG. 6, the typical delivery profiles of the current invention compare favourably with the delivery profiles of the systems utilising electronic fuel metering.

It is accepted that in fuel injection systems, a fuel rich leading edge helps attain higher performance due to the longer time available for in-cylinder air utilisation. Further to this, it is also accepted that a leaner trailing edge assists in enhancing ignitability and allows for more retarded injection windows to be used. As is evident from FIG. 6, the fuel flux profiles of both these systems show a higher degree of modulation than the typical square wave of a single fluid system.

The fuel injection system according to the present invention leads to a number of benefits over and above known dual fluid injection systems. No extra fuel injector is needed as would be required in the Applicants' earlier fuel injection system.. The fuel injection system however retains functionality while at the same time being a relatively simpler system.

The above description is provided for the purposes of exemplification only and it will be understood by a person skilled in the art that modifications and variations may be made without departing from the invention.

What is claimed is:

1. A fuel injection assembly for an internal combustion engine comprising:

a delivery chamber located within the fuel injector assembly;

a gas supply means for supplying gas;

a mass flow rate control means for controlling the mass flow rate of fuel and gas supplied to the delivery chamber, the mass flow rate being a function of a differential pressure across the mass flow rate control means, wherein the mass flow rate control means includes at least a gas mass flow rate control means, the gas mass flow rate control means being a gas orifice located in the gas supply means; and valve means for selectively communicating the delivery chamber to the engine to deliver fuel to the engine, wherein when the valve means is opened, at least compressed gas is caused to flow thereby generating a differential pressure across the mass flow rate control means such that a controlled fuel flow is provided to the engine.

2. A fuel injector assembly according to claim 1, wherein the mass flow rate control means includes a fuel mass flow rate control means and the gas mass flow rate control means.

3. A fuel injector assembly according to claim 2, wherein the fuel mass flow rate control means is a fuel orifice located in a fuel supply means.

4. A fuel injector assembly according to claim 3, wherein the gas orifice separates a gas supply passage of the fuel injector assembly from the delivery chamber, and the fuel orifice separates a fuel supply passage of the fuel injector assembly from the delivery chamber.

5. A fuel injector assembly according to claim 2, wherein the mass flow rate control means includes a venturi passage having a throat,.the venturi passage being located in the gas supply means and a fuel orifice provided in the throat section of the venturi passage, the fuel orifice being in communication with a fuel supply means.

6. A fuel injector assembly according to claim 5, wherein the venturi passage separates a gas supply passage of the fuel injector assembly from the delivery chamber, and the fuel orifice separates a fuel supply passage of the fuel injector assembly from the delivery chamber.

7. A fuel injector assembly according to claim 1, further including a check valve located upstream and adjacent the fuel mass flow rate control means.

8. A fuel injector assembly according to claim 1, further including a check valve located downstream and adjacent to fuel mass flow rate control means.

9. A fuel injector assembly according to claim 1, further including a check valve located upstream and adjacent the gas mass flow rate control means.

10. A fuel injector assembly according to claim 1, further including a check valve located downstream and adjacent the gas mass flow rate control means.

11. A fuel injector assembly according to claim 1, wherein the valve means includes a solenoid actuated poppet valve.

12. A fuel injector assembly according to claim 1, valve means includes a mechanically actuated poppet valve.

13. A fuel injector assembly according to claim 12, wherein the valve means includes spring regulation means for preventing the opening of the valve means until the gas and/or fuel supply pressure to the valve means is above a predetermined level.

14. A fuel injection system for an internal combustion engine including an air and fuel rail for supporting at least one fuel injector assembly according to any one of the preceding claims, the air and fuel rail having an air duct and a fuel duct for enabling compressed gas and fuel to be respectively supplied to the at least one fuel injector assembly.

15. A fuel injection system for an internal combustion engine, comprising:

at least one fuel injector assembly having a delivery chamber located therein;

a fuel supply means for supplying fuel to the delivery chamber;

a gas supply means for supplying compressed gas to the delivery chamber;

a mass flow rate control means for controlling the mass flow rate of the fuel and the compressed gas supplied to the delivery chamber, the mass flow rate being a function of the differential pressure across the mass flow rate control means, wherein the mass flow rate control means includes at least a gas mass flow rate control means, the gas mass flow rate control means being a gas orifice located in the gas supply means; and valve means for selectively communicating the delivery chamber of the fuel injector assembly to the engine to deliver fuel to the engine, wherein when the valve means is opened, at least compressed gas is caused to flow thereby generating a differential pressure across the mass flow rate control means such that a controlled fuel flow rate is provided to the engine.

16. A fuel injection system according to claim 15, wherein the mass flow rate control means includes a fuel mass flow rate control means and the gas mass flow rate control means.

17. A fuel injection system according to claim 16, wherein the fuel mass flow rate control means is a fuel orifice located in a fuel supply means.

18. A fuel injection system according to claim 17, wherein the gas orifice separates a gas supply passage of the fuel injector assembly from the delivery chamber, and the fuel orifice separates a fuel supply passage of the fuel injector assembly from the delivery chamber.

19. A fuel injection system according to claim 16, wherein the mass flow rate control means includes a venturi passage having a throat section, the venturi passage being located in the gas supply means and a fuel orifice provided in the throat section of the venturi passage, and fuel orifice being in communication with the fuel supply means.

20. A fuel injection system according to claim 19, wherein the venturi passage separates a gas supply passage of the fuel injector assembly from the delivery chamber, and the fuel orifice separates a fuel supply passage of the fuel injector assembly from the delivery chamber.

21. A fuel injection system according to any one of claims 15 to 20, further including a check valve located upstream and adjacent the fuel mass flow rate control means.

22. A fuel injection system according to any one of claims 15 to 20, further including a check valve located downstream and adjacent the fuel mass flow rate control means.

23. A fuel injection system according to any one of claims 15 to 20, further including a check valve located upstream and adjacent the gas mass flow rate control means.

24. A fuel injection system according to a claim 15, further including a check valve located downstream and adjacent the gas mass flow rate control means.

25. A fuel injection system according to claim 15, wherein the valve means includes a solenoid actuated poppet valve.

26. A fuel injection system according to claim 15, wherein the valve means includes a mechanically actuated poppet valve.

27. A fuel injection system according to claim 15, wherein the valve means includes spring regulation means for preventing the opening of the valve means until the gas and/or fuel supply pressure to the valve means is above a predetermined level.

28. A fuel injection system according to claim 15, further including a pressure equalising means for at least substantially equalising the supply pressure of the fuel and the compressed gas supplied to the at least one fuel injector assembly.

29. A fuel injection system according to claim 28, wherein the pressure equalising means includes a closed tank to which compressed gas and fuel is supplied and a fuel control means for controlling the amount of fuel supplied to the tank.

30. A fuel injection system according to claim 29, wherein the fuel control means is a float valve adapted to prevent further fuel supply to the tank when the fuel reaches a predetermined level therein.

31. A fuel injection system according to claim 29, wherein the fuel control means is a fuel level switch.

32. A method of metering fuel to an internal combustion engine comprising at least one fuel injector assembly including a delivery chamber, a mass flow rate control means for controlling the mass flow rate of compressed gas and the mass flow rate of fuel supplied to the delivery chamber, and valve means for selectively communicating the delivery chamber to the engine to deliver fuel to the engine, the method comprising the steps of:

providing a source of fuel to the delivery chamber;

providing a source of compressed gas to the delivery chamber;

controlling the mass flow rate of fuel and gas supplied to the delivery chamber as a function of the differential pressure across the mass flow rate control means, by opening the valve means to cause compressed gas to flow therethrough resulting in a differential pressure across the mass flow rate control means to result in a controlled fuel flow to the engine, wherein the mass flow rate control means includes at least a mass flow rate control means, the gas mass flow rate control means being a gas orifice located in a gas supply means.

33. A method according to claim 32, wherein the mass flow rate control means includes a gas flow rate control means for controlling the mass flow rate of compressed gas and a fuel flow rate control means for controlling the mass flow rate of fuel, the mass flow rate of gas supplied to the delivery chamber being controlled as a function of the differential pressure across the gas flow rate control means and the mass flow rate of fuel supplied to the delivery chamber being controlled as a function of the differential pressure across the fuel flow rate control means.

34. A method according to claim 32, further including regulating the supply pressure of the fuel and of the gas to the delivery chamber such that the fuel supply pressure is at least substantially equalised with the gas supply pressure.

35. A method according to claims 32, further including restricting the communication of the source of fuel to the delivery chamber until the differential pressure exceeds a predetermined level.

36. A method according to claims 32, including controlling the amount of fuel supplied to the engine by controlling at least one of the fuel and gas supply pressures.

37. A method according to claims 32, including initially controlling the amount of fuel supplied to the engine by varying the period of opening of the valve means.

38. A method according to claims 32, including initially controlling the amount of fuel supplied to the engine by varying the start and/or end times of the opening of the valve means.

39. A fuel injector assembly for an internal combustion engine, comprising:

a delivery chamber located within the fuel injector assembly;

a mass flow rate control means for controlling a mass flow rate of fuel and compressed gas supplied to the delivery chamber, the mass flow rate being a function of a differential pressure across the mass flow rate control means, wherein the mass flow rate control means includes a venturi passage having a throat section, the venturi passage being located in a gas supply means and a fuel orifice provided in the throat section of the venturi passage, the fuel orifice being in communication with a fuel supply means; and valve means for selectively communicating the delivery chamber to the engine to deliver fuel to the engine, wherein when the valve means is opened, at least compressed gas is caused to flow thereby generating a differential pressure across the mass flow rate control means such that a controlled fuel flow is provided to the engine.

40. A fuel injection system for an internal combustion engine, comprising:

at least one fuel injector assembly having a delivery chamber located therein;

a fuel supply means for supplying fuel to the delivery chamber;

a compressed gas supply means for supplying compressed gas to the delivery chamber;

a mass flow rate control means for controlling a mass flow rate of the fuel and compressed gas supplied to the delivery chamber, the mass flow rate being a function of a differential pressure across the mass flow rate control means, wherein the mass flow rate control means includes a venturi passage having a throat section, the venturi passage being located in the gas supply means and a fuel orifice provided in the throat section of the venturi passage, the fuel orifice being in communication with the fuel supply means; and valve means for selectively communicating the delivery chamber of the fuel injector assembly to the engine to deliver fuel to the engine, wherein when the valve means is opened, at least compressed gas is caused to flow thereby generating a differential pressure across the mass flow rate control means such that a controlled fuel flow rate is provided to the engine.

* * * * *